United States Patent [19]

Currier

[11] Patent Number: 4,961,509

[45] Date of Patent: Oct. 9, 1990

[54] BULK PAINT CONTAINERS AND METHOD OF MAKING SAME

[76] Inventor: Glenn Currier, 7330 River Rd., Flushing, Mich. 48433

[21] Appl. No.: 308,475

[22] Filed: Feb. 10, 1989

[51] Int. Cl.[5] ..... B65D 87/00

[52] U.S. Cl. ..... 220/5 A; 220/1.5; 220/465

[58] Field of Search ..... 220/5 A, 1.5, 465, 466, 220/469, 444, 1 B, 68

[56] References Cited

U.S. PATENT DOCUMENTS

| | | | |
|---|---|---|---|
| 2,271,660 | 2/1942 | Norbom | 220/1.5 X |
| 3,059,804 | 10/1962 | Wissmiller | 220/465 |
| 3,069,045 | 12/1962 | Haumann et al. | 220/465 X |
| 4,648,521 | 3/1987 | Thomas et al. | 220/5 A X |
| 4,746,034 | 5/1988 | Ata et al. | 220/1.5 X |
| 4,782,973 | 11/1988 | Wiese | 220/1.5 X |
| 4,838,443 | 6/1989 | Cripe et al. | 220/1.5 X |
| 4,840,284 | 6/1989 | Snyder | 220/5 A |

*Primary Examiner*—Steven M. Pollard
*Attorney, Agent, or Firm*—Dykema Gossett

[57] ABSTRACT

A replacement bottom for a bulk paint container is disclosed in which a drain valve is mounted above the lowermost extent of the container portion so that the bulk paint container can be picked up by a forklift in any one of four directions. The bulk paint container has a body with an inner bottom wall and an outer bottom wall and has a synthetic filler in the area between the inner and outer bottom walls. Leg members are bolted to the body and are formed of a single piece of metal that is folded upon itself to form a polygonal leg. In addition, the outer side wall of the bulk paint container is formed from a single piece of metal that is folded upon itself to create a polygonal member. The drain valve is bolted to the inner bottom wall and is easily replaced. The replacement bottom is welded to the top of an existing bulk container, preferably at two weld points, one inside the container and one outside the container.

21 Claims, 4 Drawing Sheets

FIG.4
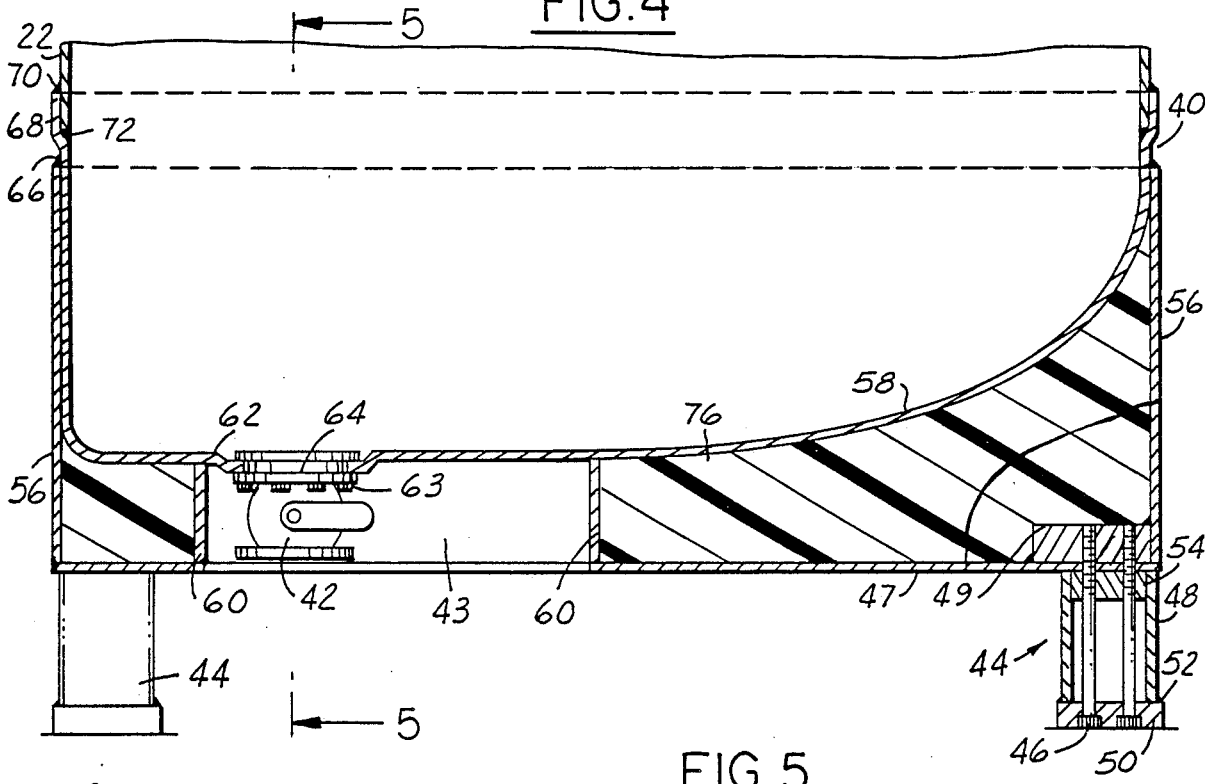
FIG.5
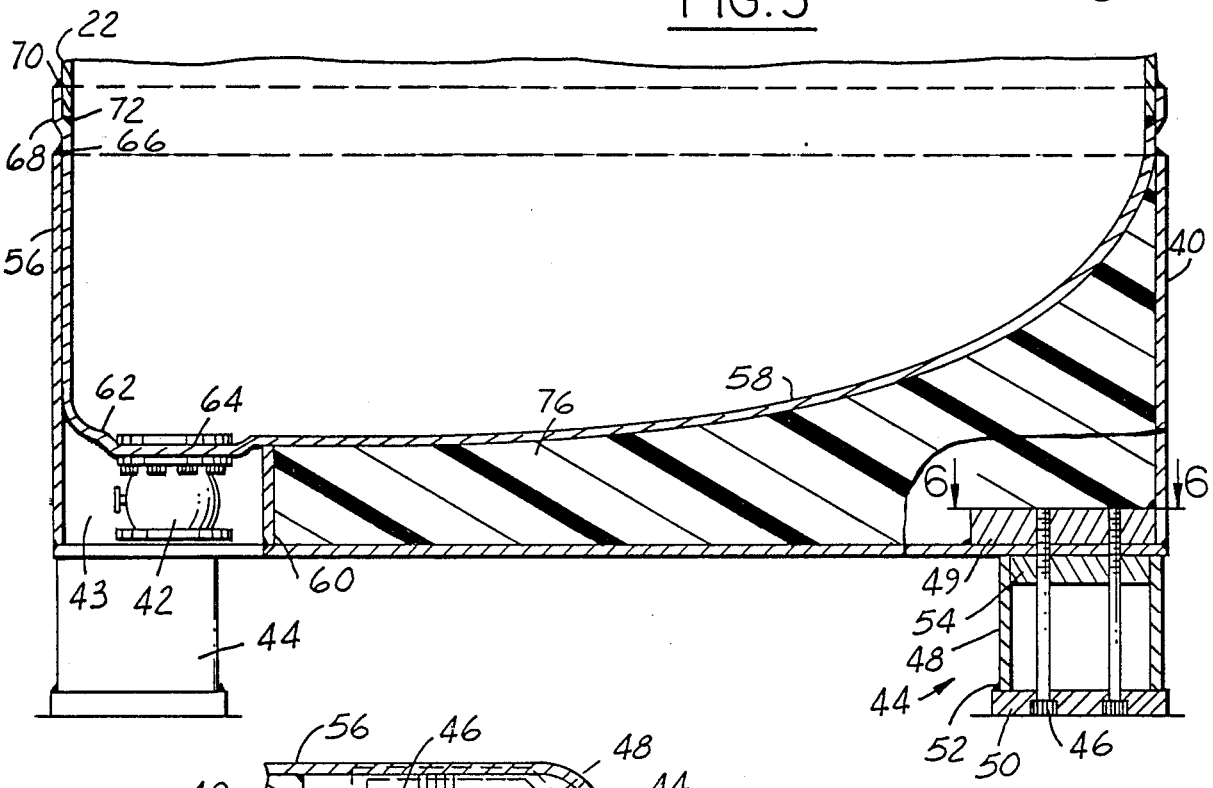
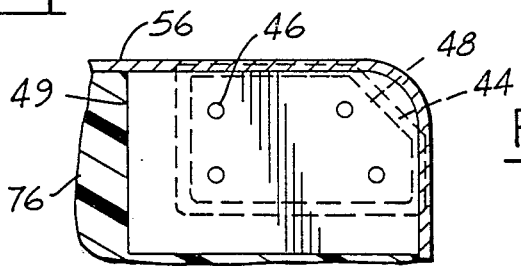
FIG.6

BULK PAINT CONTAINERS AND METHOD OF MAKING SAME

BACKGROUND OF THE INVENTION

The present invention relates generally to containers for storing bulk quantities of paint and a method of making these containers.

Paint for use in bulk quantities, such as with an automobile assembly plant, is usually stored in bulk containers. These containers store large quantities of the paint and thus are quite heavy requiring transportation with the use of a forklift. A filled container weighs about 5000 pounds. The prior art containers are usually thin metal-walled structures, and stresses are created therein when lifted by the forklifts that often crack the containers. In addition, the prior art containers are difficult to clean and require regular maintenance.

One example of a prior art container is shown in FIG. 1. The bulk Paint container 20 consists of a thin-walled metal body with an outer wall 22 defining a paint receiving space 24. The walls are stainless steel and 3/16 inches thick. An upper port 26 is formed in the roof or top 27 of the container and provides access into the inner space 24 of the container. In some prior containers, the port was in the bottom wall. A drain valve 28 is formed in a single bottom wall 29 of the container and drains the paint from the container. The drain valve 28 is placed between two of the legs 30, and the drain valve 28 extends downwardly below the bottom wall 29 of the bulk paint container. A valve guard 31 is placed to protect the drain valve 28. Upper support portions 32 are mounted on the upper portion 27 of the container.

Another prior art container is shown in FIG. 2. The prior art container 34 shown in FIG. 2 is similar to that shown in FIG. 1 except a new bottom 36 has been welded at 38 to the wall 22 of the thin-walled body. The weld joint was not ground down in this Prior art container. Frequently in the prior art, the bottom 29 would crack, often at the joint with the leg 30, and would need to be replaced. The prior art container 34 required cutting away the bottom of the thin-walled container 22 and welding a new bottom, such as shown at 36, to the remaining portion of the container.

These two prior art paint containers were deficient in several areas. First of all, with the drain valve 28 being disposed between two of the legs and extending downwardly below the bottom wall 29, a forklift could only approach the containers from two directions. The forklift could go between the two legs 30 illustrated in FIGS. 1 and 2; however, the forklift could not come in from the other direction, that is, between the leg 30 and another set of legs 30 not illustrated but which would be disposed in a plane further into the paper. Since the drain valve 28 and valve guard 31 were mounted between these legs and below the floor or bottom wall 29, a forklift could not go between the legs in that direction; otherwise, it could break off the drain valve 28. In fact, in the prior art, the valve guard 31 is often bent and must be replaced. Due to this feature, a forklift would have to be maneuvered around until it was aligned with the bulk containers in the proper direction. At a common painting facility, it is necessary to have 8–10 colors available, each in a separate container. The ability to store the bulk paint containers of the rior art was limited, since they would have to be stored leaving access between the legs 30 in a direction that would not cause a forklift to bump into the drain valve 28.

The prior art drain valve 28 was threaded into the bottom wall 29 and was unscrewed to allow draining. The wall threads in the wall would wear out, and it is necessary to cut out a section of the bottom and weld in a new wall section and thread.

In addition, the prior art bulk paint containers were difficult to empty and clean. As shown in the drawings, FIGS. 1 and 2, the bottoms 29 of both containers were flat and parallel. This caused puddles of paint to remain upon the floor or bottom wall 29 when the containers were emptied. Usually, 3–10 percent of the paint remains in the bottom; this paint is wasted. These containers were difficult to clean, and the paint was difficult to remove. The bulk paint containers of the prior art would have to be shipped to a distant location for cleaning by a person entering into the container through the top opening 26 and scrubbing down the walls of the container. The rough weld areas are very difficult to clean and require scrubbing with a brush to remove the paint. This also created problems because after cleaning by this method was done, the cleaning fluid would often remain in puddles on the bottom of the container, causing more problems. The stainless steel walls were porous and often absorbed some of the cleaning fluid or water. After a period of time, for example a half-hour after the cleaning had been done, the fluid would leak back out of the porous stainless steel walls and would again puddle on the bottom 29 of the prior art bulk containers.

Another problem with the bulk paint containers of the prior art is the thin-walled bottom would buckle when lifted by the forklifts. The prior art bulk paint containers could be seen to visibly buckle when lifted, and the resulting stresses from this buckling would create many of the cracks associated with the prior art.

It is an object of the present invention to create a bulk paint container that may be lifted by a forklift in any one of the four possible directions.

It is further an object of the present invention to create a bulk paint container that can be easily drained and if necessary cleaned.

It is further an object of the present invention to create a bulk paint container with weld joints that will provide adequate seals, thus preventing leakage of any paint.

It is further an object of the present invention to provide a method of assembling these members.

SUMMARY OF THE INVENTION

The present invention discloses an improved bulk paint container and a method of assembling the same. In the present invention, the drain valve is mounted above the bottom wall of the bulk paint container, thus allowing the bulk paint container to be lifted in any one of four directions by the fork lift. In addition, the inner bottom wall of the bulk paint container defining the space that holds the paint is curved downwardly at all points so the drain valve is at the lowest point in the container, thereby draining all the paint from the container.

It is an object of the present invention to utilize a valve that can be replaced without cutting out a section of the bottom wall. The valve of the present invention is bolted to the bottom wall.

The bottom portion of the bulk paint container of the present invention is attached to the top portion by a double weld joint that prevents any possible leakage. The legs of the bulk paint container of the present invention are bolted into the body of the paint container so they are firmly mounted and will not crack away, causing cracks in the body of the paint container. The space between the bottom of the paint container body and the bottom of the inner paint container defining the inner space that holds the paint is separated by a quantity of a synthetic filler material, as an example, urethane or urethane foam, acting to transfer weight to the side walls and make the bottom portion of the paint container sturdy so it will not buckle when lifted by a forklift. The material chosen must have sufficient strength to tranfer the weight, yet be resilient enough to act as a cushion. The legs and body of the paint container are each formed of a single piece of metal bent around upon itself in order to form a polygonal part having only one axial weld joint, thus limiting the potential leakage points.

These and other features of the present invention can be best understood upon reading the following disclosure taken in conjunction with the drawings.

BRIEF DESCRIPTION OF THE DRAWINGS

FIG. 4 is a cross-sectional view through a bulk paint container as disclosed by the present invention taken along the line 4—4 of FIG. 3.

FIG. 5 is a cross-sectional view through a bulk paint container as disclosed by the present invention taken along the line 5—5 of FIG. 4.

FIG. 6 is a close-up cross-sectional view showing the mounting of a leg to the main body of the bulk paint container of the present invention taken along the line 6—6 of FIG. 5.

DETAILED DESCRIPTION OF AN EMBODIMENT OF THE INVENTION

The features of the bulk paint container of the present invention can be understood upon a review of FIGS. 3–6 and 13.

Figure 1:
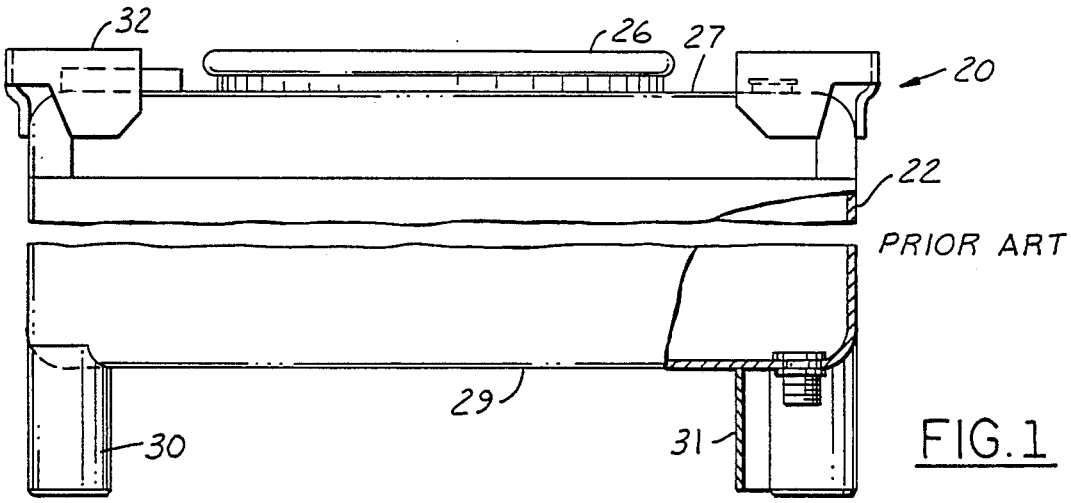
FIG. 1 is a cross-sectional view through a prior art bulk paint container.
Figure 2:
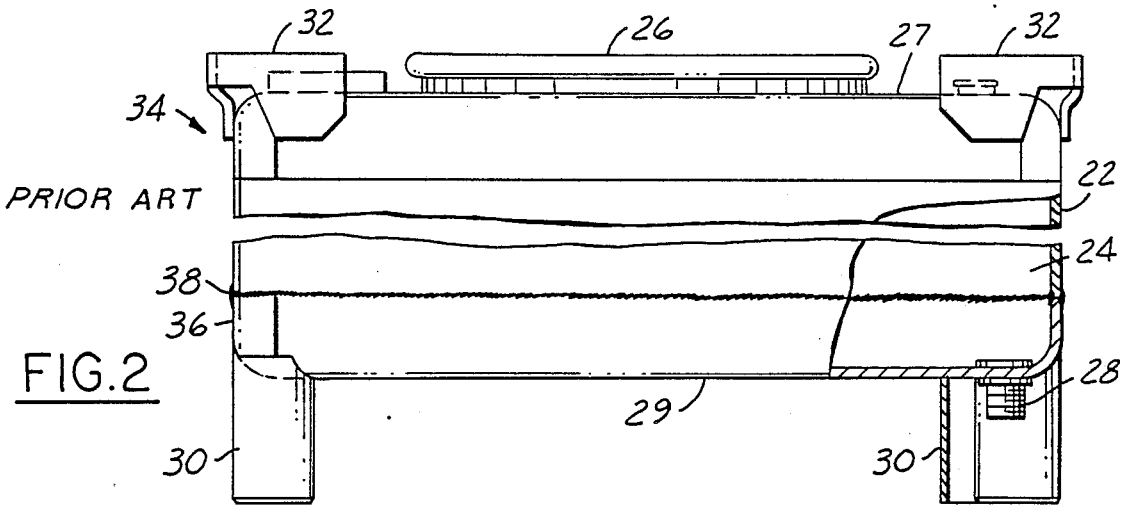
FIG. 2 is a cross-sectional view through a prior art bulk paint container with a replacement bottom having been welded thereto.
Figure 3:
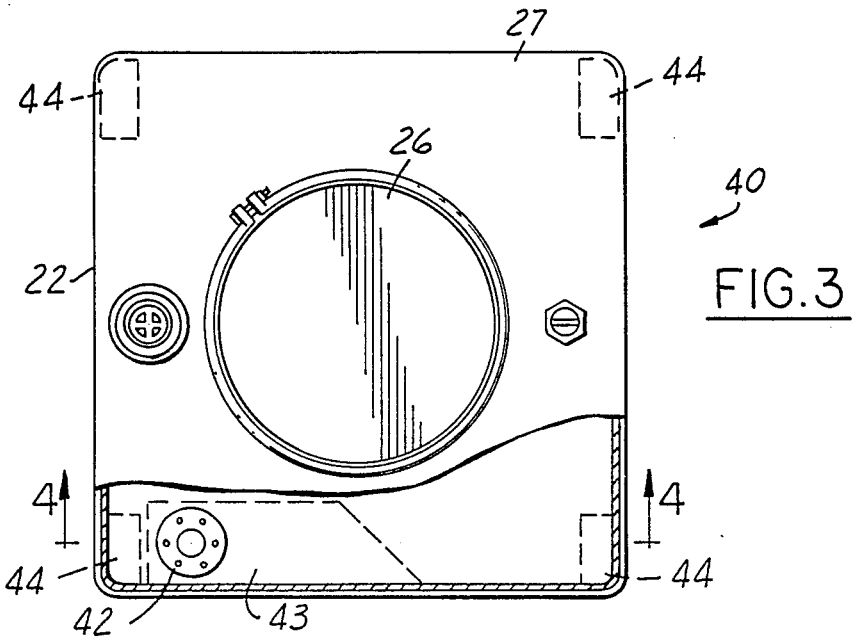
FIG. 3 is a view of the top of a bulk paint container as disclosed by the present invention.

As shown in FIG. 3, the bulk paint container 40 of the present invention has a body with a upper wall portion 22, port 26, and upper member 27 similar to the prior art devices. However, the drain valve 42 is mounted in a drain valve space 43, and the legs 44 are somewhat different than in the prior art.

As can be seen in FIG. 4, the drain valve 42 of the present invention is mounted within its own space 43, and the drain valve 42 is mounted above the outer bottom wall 47 of the body of the bulk paint container.

The leg 44 can be seen to comprise a number of parts bolted at 46 through the bottom wall 47 consisting of a side wall 48, a bottom portion 50 welded at 52 to the side wall portion 48, and an inner plug portion 54 with taped holes to receive the bolts 46. As can be seen, the bolts 46 are countersunk in bottom 50, go through the bottom wall 47 and are received in a plug 51 mounted in a notch 49 formed in a filler 76 to be described later.

The bulk paint container 40 of the present invention is essentially a replacement bottom that can be attached to the upper outer wall 22 of the prior art bulk paint containers. The body of the bulk paint container 40 comprises a side wall 56 defining the outer boundaries of the bulk paint container and an inner bottom member 58 acting to define the paint receiving portions. Portions 60 of the side wall 56 define the valve receiving space 43. A flange 62, FIG. 13, of the inner bottom wall 58 surrounds an opening and is formed to be received in a groove 64 formed between flanges 90, 92 of the valve 42 to mount the valve 42 to the inner bottom wall 58. Bolts 63 secure the valve 42 to the flange 62 and allow easy replacement of the valve 42. Flange 90 is a mounting flange and is a separate part from the flange 92. The mounting flange 90 acts as a nut to receive the bolts 63. Paper gaskets 94, 96 are placed between the flanges 90, 62 and 92. The flange 92 is preferably integral with the drain valve 42. Drain passage 98 can be seen to extend through the flange 90, the flange 92 and into the valve 42. The side wall 56 is welded at 66 to the inner bottom wall 58, and the inner bottom wall has an out-jutting flange 68 that receives the upper wall 22 of the bulk paint container and is welded thereto at 70 and 72. The inner weld 72 is ground smooth to eliminate problems with cleaning. This provision of an inner weld 72 and an outer weld 70 ensures that there will be no leakage from inside the container that would cause a potential hazardous spill problem. If weld 72 cracks, it is backed up by weld 70.

As as example, the space between the inner bottom wall 58 and the outer bottom wall 47 is filled with a filler matrial 76 such as a hard, 60–80 durometer urethane foam that rigidifies the overall bulk paint container and eliminate the buckling problems that were experienced by the prior art. The filler material 76 transfers some of the weight to the side walls and removes the weight from the forks. This rigidifies the container while providing a resilient cushioning filler. The use of urethane or other filler material results in a lighter, less expensive product than if a metal were used as the filler material.

FIG. 5 is a view perpendicular to that shown in FIG. 4. As can be seen from FIG. 5 taken in conjunction with FIG. 4, since the drain valve 42 is mounted above the level of the bottom wall 47, a forklift can approach the bulk paint container 40 of the present invention in any one of four directions.

FIG. 6 is a view looking downwardly that will illustrate the mounting of one of the legs 44 to the bulk paint container 40 of the present invention. As can be seen in FIG. 6, the opening 49 in the filler material 76 receives the bolts 46 that secure the legs 44 to the container 40.

Figure 7:
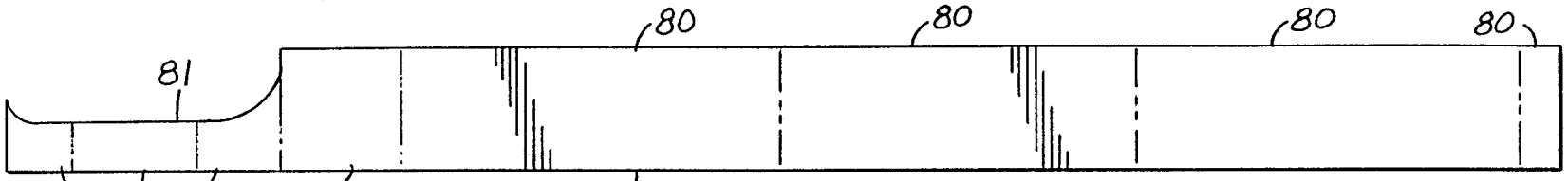
FIG. 7 illustrates the shape of a part folded together to create the main side body portion of the bulk paint container of the present invention.

The method of assembling the main body parts of the bulk paint container 40 of the present invention can be best understood upon reviewing FIGS. 7–12. As shown in FIG. 7, the entire side wall 56 of the bulk paint container 40 of the present invention is formed of a single piece of metal. There are five portions 80 that each form a side of the overall side wall 56 and three portions 60 that form the portions of the side wall 56 that will define the valve receiving space 43. In addition, there is shown to be a cutaway notched portion 81 at the side wall 56 along the portions 60.

Figure 9:
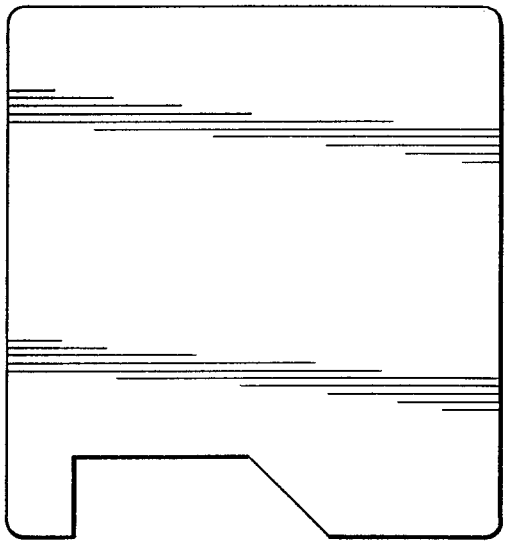
FIG. 9 shows a view of the bottom of the bulk container of the present invention.
Figure 8:
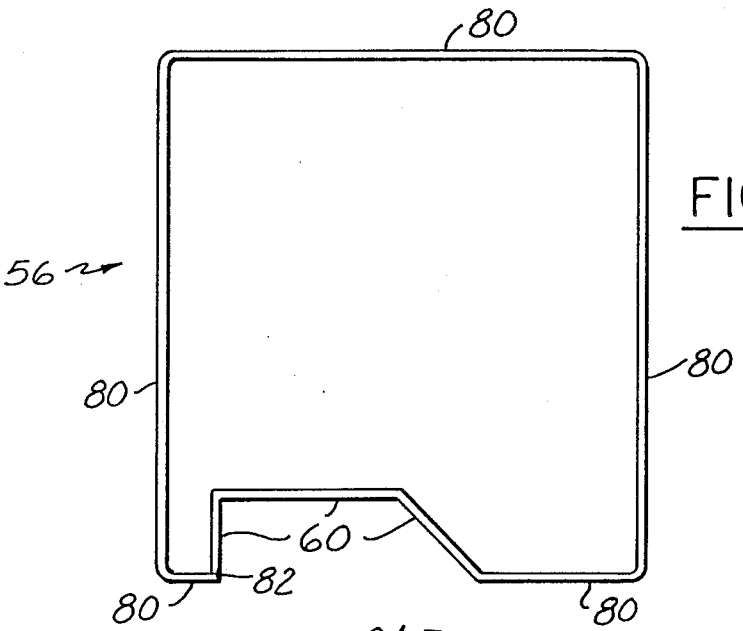
FIG. 8 shows the part illustrated in FIG. 7 in its assembled condition.

As can be seen in FIG. 8, the single piece of metal used to form the side wall 56 is folded upon itself into a polygonal shape as shown in FIG. 8 and is welded to itself at 82 to form a single rigid container side wall 56. The part is folded to have a 2-inch radius at each corner. By assembling the side wall 56 in this way, a device is arrived at that has only one weld joint along its entire surface. The weld joint is at the end of the notch 81 and thus will be shorter than if it were between two portions 80. FIG. 9 shows the shape of the bottom wall 47 required by the present invention.

Figure 10:
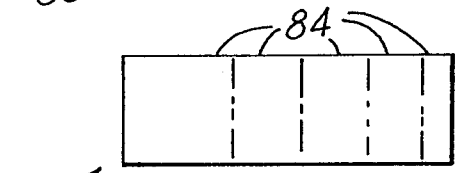
FIG. 10 illustrates the shape of a part folded together to create a leg of the bulk paint container of the present invention.
Figure 13:
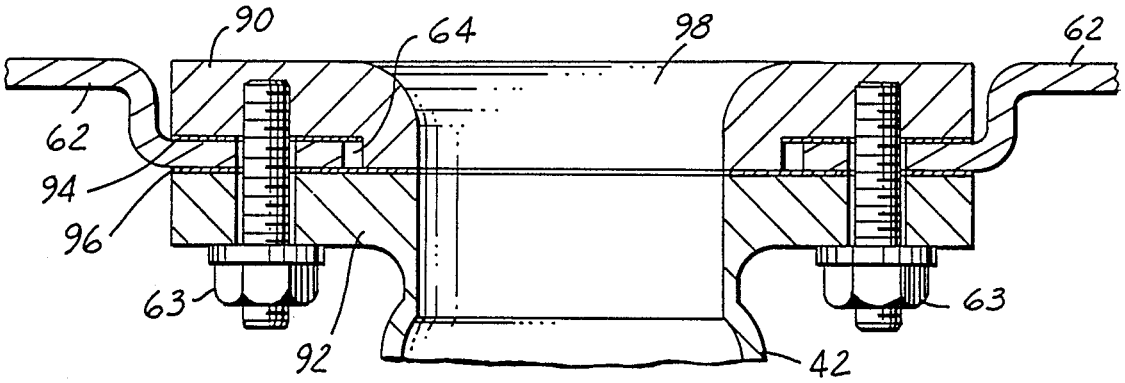
FIG. 13 is an enlarged view of the mounting for a drain valve that is employed in the present invention.

FIG. 10 shows the single part used to form the side wall 48 of the legs 44. As shown in FIG. 10, the side wall 48 of the legs 44 will be formed of five sides 84.

Figure 12:
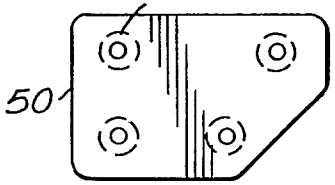
FIG. 12 is a view showing the bottom of one leg as disclosed by the present invention.
Figure 11:
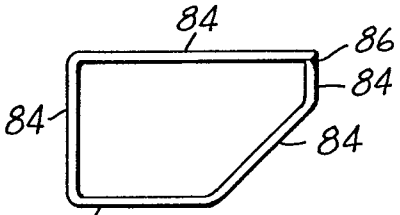
FIG. 11 shows the part illustrated in FIG. 10 in its assembled position.

As can be seen in FIG. 11, the five sides 84 are bent upon themselves into a polygonal shape and welded to each other at 86. By assembling the legs in this manner, a leg side wall is arrived at that is integral save for the one weld joint at 86. The leg members 50, 54 are then attached to form the legs 44. FIG. 12 shows the construction of the bottom 50 of one of the legs 44 and illustrates the bolts 46 countersunk therein.

The various parts are assembled to form a replacement bottom by constructing the side wall 56 and four legs 44. The inner bottom portion 58 is then welded at 66 to the side wall 56. The filler 76 is then placed in the space defined by the side wall 56 at the bottom portion 58. Plugs 51 are placed in the openings 49. Outer bottom portion 47 is welded to the side wall 56. Drain valve 42 is bolted at 63 between flanges 90, 92 to the flange 62. The legs 44 are bolted into the plugs 51.

The new bottom construction can now be welded to an existing top of a prior art bulk paint container as a replacement, the bottom of this prior art container already having been cut away. The bottom construction is welded at 70 outside the container and at 72 inside the container. The weld 72 is ground down to leave a smooth, easily cleaned surface.

If the valve 42 needs to be replaced it can be replaced by merely removing the bolts 63. The mounting flange 90 can be retained and used to mount the new drain valve.

An embodiment and method of assembly of the present invention has been disclosed but is not to be limiting. A worker in the art could envision several modifications. For instance, the container could be used to store some other liquid besides paint or any other fluent material such as a powder. The intended scope of the present invention can be best understood from the appended claims.

I claim:

1. A bulk container comprising:

a body, said body having an inner bottom portion defining a receiving space and an outer bottom portion defining the lowermost extent of said body;

a drain valve mounted to said inner bottom portion for draining the receiving space and extending below said inner bottom portion, the lowermost extent of said drain valve being higher than the lowermost extent of said outer bottom portion; and upstanding leg members mounted to the body to hold the body off the ground;

said inner bottom portion is curved in such a way that said drain valve is mounted to the lowermost location of said inner bottom portion and all other locations on said inner bottom portion curve downwardly to this lowermost location.

2. A bulk container as recited in claim 1, and further wherein each of said legs comprise bolt members securing the leg to the body.

3. A bulk container as recited in claim 2, and further wherein a filler material is disposed between the inner bottom portion and the outer bottom portion.

4. A bulk container as recited in claim 3, and further wherein the bolt securing said legs to said body is received in an insert portion mounted in a notch formed in the filler disposed between inner and outer bottom portions.

5. A bulk container as recited in claim 1, and further wherein said drain valve is bolted to said inner bottom portion.

6. A bulk container as recited in claim 1, and further wherein said body further comprises an outer side wall, said outer side wall being formed of a single piece of metal bent upon itself and welded at one position to form a polygonal member.

7. A bulk container comprising:

a body, said body having an inner bottom portion defining a receiving space and an outer bottom portion defining the lowermost extent of said body;

a drain valve mounted to said inner bottom portion for draining the receiving space and extending below said inner bottom portion, the lowermost extent of said drain valve being higher than the lowermost extent of said outer bottom portion; and upstanding leg members mounted to the body to hold the body off the ground;

said body further comprises an outer side walls, said outer side wall being formed of a single piece of metal bent upon itself and welded at one position to form a polygonal member;

said outer side wall has a notched position with a shorter height than the remainder of said outer side wall and said weld position is at this notched position, thus resulting in a weld joint that is shorter than the nominal height of said outer side wall.

8. A bulk container as recited in claim 1, and further wherein said upstanding leg members comprise a leg outer side wall formed of a single piece of metal bent upon itself and welded at one position;

a leg bottom member;

a leg upper plug member;

said leg upper plug member and said leg bottom member being connected to said leg outer side wall at the two axial extents of said leg outer side wall; and bolt members being countersunk in said leg bottom portion extending axially through said leg outer side wall, through said leg upper member plug and through said outer bottom portion of said container to secure said upstanding leg members to said container.

9. A method of assembling a bulk container comprising the steps of:

forming a body with a bottom portion and an outer side wall portion;

forming four leg members, each of the leg members having a leg side portion; and forming at least one of the side wall or the four leg side portions from a single piece of metal folded upon itself and welded along one weld joint to form a polygonal member, the side wall being formed of a single piece of metal, notching out a portion of the single piece of metal at one axial extent to form a portion of the side wall with a lesser height than the remainder of the side all, and welding together the two extents of the single piece of metal at the notched portion.

10. The method of assembling a bulk container as recited in claim 9, and further comprising the steps of:

forming the side wall and the four leg side portions from a single piece metal folded upon itself.

11. The of assembling a bulk container as recited in claim 10, and further comprising the steps of:

disposing an inner bottom wall and an outer bottom wall within the body; and disposing a filler material between the inner bottom portion and the outer bottom portion.

12. A replacement bottom for a bulk container comprising:

a body, said body having an inner bottom portion defining a receiving space and an outer bottom portion defining the lowermost extent of the body;

a drain valve mounted to said inner bottom portion for draining the receiving space and extending below the inner bottom portion, the lowermost extent of said drain valve being higher than the lowermost extent of the outer bottom portion;

upstanding leg members mounted to the body to hold the body off the ground; said inner bottom portion being curved in such a way that the drain valve is mounted to the lowermost location of the inner bottom portion and all other locations on the inner bottom portion curve downwardly to this lowermost location.

13. A replacement bottom for a bulk container as recited in claim 12, and further wherein a synthetic filler material is disposed between the inner bottom portion and the outer bottom portion.

14. A replacement bottom for a bulk container as recited in claim 12 and further wherein each of said legs comprise bolt members securing the leg to the bulk paint container.

15. A replacement bottom for a bulk container as recited in claim 14, and further wherein a synthetic filler material is disposed between the inner bottom portion and the outer bottom portion.

16. A replacement bottom for a bulk container as recited in claim 15, add further wherein the bolt securing said legs to said bulk container is received in an insert portion mounted in a notch formed in the filler disposed between the inner and outer bottom portions.

17. A replacement bottom for a bulk container as recited in claim 12, and further wherein said drain valve is bolted to said inner bottom portion.

18. A replacement bottom for a bulk container as recited in claim 12, and further wherein said body further comprises an outer side wall, said outer side wall being formed of a single piece of metal bent upon itself and welded at one position to form a polygonal member.

19. A replacement bottom for a bulk container comprising:

a body, said body having an inner bottom portion defining a receiving space and an outer bottom portion defining the lowermost extent of the body;

a drain valve mounted to said inner bottom portion for draining the receiving space and extending below the inner bottom portion, the lowermost extent of said drain valve being higher than the lowermost extent of the outer bottom portion;

upstanding leg members mounted to the body to hold the body off the ground;

said body further comprising an outer side wall, said outer side wall being formed of a single piece of metal bent upon itself and welded at one position to form a polygonal member;

said outer side wall having a notched position with a shorter height than the remainder of the outer side wall and said weld position is at this notched position, thus resulting in a weld joint that is shorter than the nominal height of the side wall.

20. A replacement bottom for a bulk container as recited in claim 12, and further wherein said upstanding leg members comprise an leg outer side wall formed of a single piece of metal bent upon itself and welded at one position;

a leg bottom member;

a leg upper plug member;

said leg upper plug member and said leg bottom member being connected to said leg outer side wall at the two axial extents of said leg outer side wall; and bolt members being countersunk in said bottom portion extending axially through said leg outer side wall, through said leg upper plug member and through said outer bottom portion of said container to secure said upstanding leg members to said container.

21. A replacement bottom for a bulk container as recited in claim 12, and further wherein said receiving space is further defined by a side wall and said inner bottom portions extend upwardly above the inner extent of said side wall, and is flanged outwardly at a position above the upper extent of said side wall.

* * * * *